US012252319B2

(12) United States Patent
Hashimoto et al.

(10) Patent No.: US 12,252,319 B2
(45) Date of Patent: Mar. 18, 2025

(54) POUCH CONTAINER

(71) Applicant: Fuji Seal International, Inc., Osaka (JP)

(72) Inventors: Mine Hashimoto, Osaka (JP); Takahiro Nakagawa, Osaka (JP)

(73) Assignee: Fuji Seal International, Inc., Osaka (JP)

( * ) Notice: Subject to any disclaimer, the term of this patent is extended or adjusted under 35 U.S.C. 154(b) by 101 days.

(21) Appl. No.: 18/219,762

(22) Filed: Jul. 10, 2023

(65) Prior Publication Data

US 2024/0010408 A1 Jan. 11, 2024

(30) Foreign Application Priority Data

Jul. 11, 2022 (JP) ..... 2022-111063

(51) Int. Cl.
*B65D 75/00* (2006.01)
*B65D 75/26* (2006.01)
*B65D 47/12* (2006.01)

(52) U.S. Cl.
CPC ..... *B65D 75/008* (2013.01); *B65D 75/26* (2013.01); *B65D 47/12* (2013.01)

(58) Field of Classification Search
CPC ..... B65D 47/12; B65D 75/008; B65D 75/26
USPC ..... 383/120
See application file for complete search history.

(56) References Cited

U.S. PATENT DOCUMENTS 5,307,955 A * 5/1994 Viegas ..... B65D 47/2031 222/173
5,409,144 A * 4/1995 Brown ..... B65D 47/2031 222/496
6,079,594 A * 6/2000 Brown ..... B29C 66/112 222/107
6,164,822 A * 12/2000 Beer ..... B65D 75/008 383/906
6,245,367 B1 * 6/2001 Galomb ..... B65D 75/008 206/541
8,844,767 B1 * 9/2014 Bates ..... B65D 47/2031
10,017,300 B2 * 7/2018 McGuire ..... B65D 25/54
10,399,750 B1 * 9/2019 Latour ..... B65D 47/0809
11,136,166 B2 * 10/2021 Holmi ..... B65D 75/5894
11,465,813 B2 * 10/2022 Young ..... B65D 35/10
11,613,417 B2 * 3/2023 Moreno Brociner ..... B65D 47/089 222/107
2008/0247682 A1 * 10/2008 Murray ..... B31B 70/00 53/457
2012/0008884 A1 * 1/2012 Murray ..... B65D 75/5805 383/104

(Continued)

*Primary Examiner* — Peter N Helvey
(74) *Attorney, Agent, or Firm* — Frost Brown Todd LLP

(57) ABSTRACT

When the front sheet portion is viewed from a front side in a pre-filling state in which a storage space is not filled with contents and the gusset sheet portion is arranged overlapping the back sheet portion in a front-rear direction, a width of the gusset sheet portion is greater than a width of the second joining portion in a width direction, the first side-end joining portion includes a first inclined portion, and the second side-end joining portion includes a second inclined portion. When the front sheet portion is viewed from the front side in a post-filling state in which the storage space is filled with contents and the gusset sheet portion faces one side in a height direction, the first inclined portion and the second inclined portion extend along the height direction.

4 Claims, 7 Drawing Sheets

(56) References Cited

U.S. PATENT DOCUMENTS

| | | | | |
|---|---|---|---|---|
| 2012/0014622 | A1* | 1/2012 | Schwallie | B65D 33/065 383/105 |
| 2014/0231453 | A1* | 8/2014 | James | B65D 47/305 222/105 |
| 2015/0003758 | A1* | 1/2015 | Warrington | A61F 9/0008 383/125 |
| 2016/0257082 | A1* | 9/2016 | Ragan | B65D 35/10 |
| 2018/0257835 | A1* | 9/2018 | Turner | B65D 75/5861 |
| 2020/0231353 | A1* | 7/2020 | Van Den Hoonaard | B65D 75/008 |
| 2024/0375841 | A1* | 11/2024 | Perea-Ochoa | B65D 75/26 |
| 2024/0375845 | A1* | 11/2024 | Graybill | B65D 47/12 |

* cited by examiner

POUCH CONTAINER

TECHNICAL FIELD

The present disclosure relates to a pouch container.

BACKGROUND ART

As a pouch container of related art, U.S. Pat. No. 10,399,750 (Patent Document 1) discloses a pouch container in which an upper end of a front panel (front sheet portion) and an upper end of a back panel (back sheet portion) are sealed to an outer edge of an upper gusset panel (upper gusset sheet portion) at an upper seal line, and a lower end of the front panel and a lower end of the back panel are sealed to an outer edge of a lower gusset panel (lower gusset sheet portion) at a lower seal line. Side portions of the front panel and side portions of the back panel are sealed to each other by side seal lines.

CITATION LIST

Patent Literature

Patent Document 1: U.S. Pat. No. 10,399,750

SUMMARY OF INVENTION

Technical Problem

In the pouch container disclosed in U.S. Pat. No. 10,399,750, the gusset sheet portions are provided on both sides (upper side and lower side) in a height direction. On the other hand, there is a demand for a configuration in which a gusset sheet portion is provided only on one side in the height direction, and an end portion of a front sheet portion and an end portion of a back sheet portion are directly sealed to each other on the other side in the height direction.

When no measure is taken in such a case, the gusset sheet portion is present on the one side in the height direction while no gusset sheet portion is present on the other side in the height direction, and thus when the container is filled with contents, a difference in a width direction of the container is generated between the one side and the other side in the height direction. Specifically, the width on the other side in the height direction where the end portion of the front sheet portion and the end portion of the back sheet portion are directly sealed to each other becomes wider than the width on the one side in the height direction, causing a feeling of oppression in the viewer. In addition, since the width on the other side in the height direction is increased, an area of a placement space is increased when the products are displayed side by side on a display shelf in a store.

The present disclosure has been made in view of the above-described problem. An object of the present disclosure is to provide a pouch container capable of suppressing variation in width in a height direction with a configuration in which a gusset sheet portion is provided on one side in the height direction, and an end portion of a front sheet portion and an end portion of a back sheet portion are directly joined to each other on the other side in the height direction.

Solution to Problem

A pouch container according to the present disclosure includes a front sheet portion and a back sheet portion facing each other in a front-rear direction, and a gusset sheet portion connected to the front sheet portion and the back sheet portion on one side in a height direction orthogonal to the front-rear direction. Each of the front sheet portion and the back sheet portion includes a first end portion located on the one side in the height direction, a second end portion located on the other side in the height direction, a first side end portion located on one side in a width direction orthogonal to the front-rear direction and the height direction, and a second side end portion located on the other side in the width direction.

The pouch container further includes a first joining portion connecting a peripheral portion of the gusset sheet portion to the first end portion of the front sheet portion and the first end portion of the back sheet portion in an annular shape; a second joining portion joining the second end portion of the front sheet portion and the second end portion of the back sheet portion; a first side-end joining portion provided connecting a one-side end portion of the first joining portion located on the one side in the width direction and a one-side end portion of the second joining portion located on the one side in the width direction, the first side-end joining portion joining the first side end portion of the front sheet portion and the first side end portion of the back sheet portion; and a second side-end joining portion provided connecting an other-side end portion of the first joining portion located on the other side in the width direction and an other-side end portion of the second joining portion located on the other side in the width direction, the second side-end joining portion joining the second side end portion of the front sheet portion and the second side end portion of the back sheet portion.

When the gusset sheet portion and the front sheet portion are viewed from a front side in a pre-filling state in which a storage space formed between the front sheet portion and the back sheet portion is not filled with contents and the gusset sheet portion is arranged overlapping the back sheet portion in the front-rear direction with the gusset sheet portion facing the front side, a width of the gusset sheet portion in the width direction is larger than a width of the second joining portion in the width direction; in addition, the first side-end joining portion includes a first inclined portion extending outward in the width direction as extending from the one-side end portion of the second joining portion toward the one side in the height direction, and the second side-end joining portion includes a second inclined portion extending outward in the width direction as extending from the other-side end portion of the second joining portion toward the one side in the height direction. When the front sheet portion is viewed from the front side in a post-filling state in which the storage space is filled with contents and the gusset sheet portion faces the one side in the height direction, the first inclined portion and the second inclined portion extend along the height direction.

In the above description, that the first inclined portion and the second inclined portion extend along the height direction encompasses not only a case where the first inclined portion and the second inclined portion are parallel to the height direction but also a case where the first inclined portion and the second inclined portion are slightly inclined with respect to the height direction. For example, the first inclined portion and the second inclined portion may be inclined with respect to the height direction in a range from approximately minus 5 degrees to approximately plus 5 degrees.

In the pouch container according to the present disclosure, when the gusset sheet portion and the front sheet portion are viewed from the front side in the pre-filling state, an angle on the storage space side of the angles formed by the first inclined portion and the second joining portion is preferably larger than 90 degrees and equal to or smaller than 110 degrees, and an angle on the storage space side of the angles formed by the second inclined portion and the second joining portion is preferably larger than 90 degrees and equal to or smaller than 110 degrees.

In the pouch container according to the present disclosure, when the gusset sheet portion is viewed from the front side in the pre-filling state, an outer edge of the gusset sheet portion may include a first side portion extending parallel to the width direction; a second side portion opposing the first side portion in the height direction on the other side in the height direction and extending parallel to the width direction; a third side portion connected to one end of the first side portion located on the one side in the width direction, the third side portion extending toward the other side in the height direction as extending outward in the width direction; a fourth side portion connected to one end of the second side portion located on the one side in the width direction, the fourth side portion extending toward the one side in the height direction as extending outward in the width direction; a fifth side portion connected to the other end of the first side portion located on the other side in the width direction, the fifth side portion extending toward the other side in the height direction as extending outward in the width direction; and a sixth side portion connected to the other end of the second side portion located on the other side in the width direction, the sixth side portion extending toward the one side in the height direction as extending outward in the width direction.

In this case, the first joining portion may include a first inner line located on an inner side of the first side portion and extending along a direction parallel to the extending direction of the first side portion, a second inner line located on an inner side of the second side portion and extending along a direction parallel to the extending direction of the second side portion, a third inner line located on an inner side of the third side portion and extending along a direction parallel to the extending direction of the third side portion, a fourth inner line located on an inner side of the fourth side portion and extending along a direction parallel to the extending direction of the fourth side portion, a fifth inner line located on an inner side of the fifth side portion and extending along a direction parallel to the extending direction of the fifth side portion, and a sixth inner line located on an inner side of the sixth side portion and extending along a direction parallel to the extending direction of the sixth side portion.

In this case, the first inner line and the third inner line may intersect at a first inner intersection point, and the second inner line and the fourth inner line may intersect at a second inner intersection point. The first inner line and the fifth inner line may intersect at a third inner intersection point. The second inner line and the sixth inner line may intersect at a fourth inner intersection point.

A first extension line obtained by extending the first inner line from the first inner intersection point toward the one side in the width direction may intersect the third side portion at a first outer intersection point. A second extension line obtained by extending the second inner line from the second inner intersection point toward the one side in the width direction may intersect the fourth side portion at a second outer intersection point. A third extension line obtained by extending the first inner line from the third inner intersection point toward the other side in the width direction may intersect the fifth side portion at a third outer intersection point. A fourth extension line obtained by extending the second inner line from the fourth inner intersection point toward the other side in the width direction may intersect the sixth side portion at a fourth outer intersection point.

An inner line of the first side-end joining portion and an inner line of the second joining portion may intersect at a first intersection point. An inner line of the second side-end joining portion and the inner line of the second joining portion may intersect at a second intersection point.

In this case, when the gusset sheet portion and the front sheet portion are viewed from the front side in the pre-filling state, in a case where a first virtual line parallel to the height direction is drawn extending from the first intersection point toward the one side in the height direction, the first virtual line is preferably located between a first inner virtual line connecting the first inner intersection point and the second inner intersection point and extending toward the other side in the height direction, and a first outer virtual line connecting the first outer intersection point and the second outer intersection point and extending toward the other side in the height direction; in addition, in a case where a second virtual line parallel to the height direction is drawn extending from the second intersection point toward the one side in the height direction, the second virtual line is preferably located between a second inner virtual line connecting the third inner intersection point and the fourth inner intersection point and extending toward the other side in the height direction, and a second outer virtual line connecting the third outer intersection point and the fourth outer intersection point and extending toward the other side in the height direction.

In the pouch container according to the present disclosure, when the gusset sheet portion is viewed from the front side in the pre-filling state, an outer edge of the gusset sheet portion may include a first side portion extending parallel to the width direction; a second side portion opposing the first side portion in the height direction on the other side in the height direction and extending parallel to the width direction; a third side portion connected to one end of the first side portion located on the one side in the width direction, the third side portion extending toward the other side in the height direction as extending outward in the width direction; a fourth side portion connected to one end of the second side portion located on the one side in the width direction, the fourth side portion extending toward the one side in the height direction as extending outward in the width direction; a fifth side portion connected to the other end of the first side portion located on the other side in the width direction, the fifth side portion extending toward the other side in the height direction as extending outward in the width direction; and a sixth side portion connected to the other end of the second side portion located on the other side in the width direction, the sixth side portion extending toward the one side in the height direction as extending outward in the width direction.

In this case, the first joining portion may include a first inner line located on an inner side of the first side portion and extending along a direction parallel to the extending direction of the first side portion, a second inner line located on an inner side of the second side portion and extending along a direction parallel to the extending direction of the second side portion, a third inner line located on an inner side of the third side portion and extending along a direction parallel to the extending direction of the third side portion, a fourth inner line located on an inner side of the fourth side portion and extending along a direction parallel to the extending direction of the fourth side portion, a fifth inner line located on an inner side of the fifth side portion and extending along a direction parallel to the extending direction of the fifth side portion, and a sixth inner line located on an inner side of the sixth side portion and extending along a direction parallel to the extending direction of the sixth side portion.

In this case, the first inner line and the third inner line may intersect at a first inner intersection point, and the second inner line and the fourth inner line may intersect at a second inner intersection point. The first inner line and the fifth inner line may intersect at a third inner intersection point. The second inner line and the sixth inner line may intersect at a fourth inner intersection point.

A first extension line obtained by extending the first inner line from the first inner intersection point toward the one side in the width direction may intersect the third side portion at a first outer intersection point. A second extension line obtained by extending the second inner line from the second inner intersection point toward the one side in the width direction may intersect the fourth side portion at a second outer intersection point. A third extension line obtained by extending the first inner line from the third inner intersection point toward the other side in the width direction may intersect the fifth side portion at a third outer intersection point. A fourth extension line obtained by extending the second inner line from the fourth inner intersection point toward the other side in the width direction may intersect the sixth side portion at a fourth outer intersection point.

An inner line of the first side-end joining portion and an inner line of the second joining portion may intersect at a first intersection point. An inner line of the second side-end joining portion and the inner line of the second joining portion may intersect at a second intersection point.

In this case, when the gusset sheet portion and the front sheet portion are viewed from the front side in the pre-filling state, at least part of the one-side end portion of the second joining portion is preferably located between a first inner virtual line connecting the first inner intersection point and the second inner intersection point and extending toward the other side in the height direction, and a first outer virtual line connecting the first outer intersection point and the second outer intersection point and extending toward the other side in the height direction; in addition, at least part of the other-side end portion of the second joining portion is preferably located between a second inner virtual line connecting the third inner intersection point and the fourth inner intersection point and extending toward the other side in the height direction, and a second outer virtual line connecting the third outer intersection point and the fourth outer intersection point and extending toward the other side in the height direction.

In the pouch container according to the present disclosure, when the gusset sheet portion is viewed from the front side in the pre-filling state, an outer edge of the gusset sheet portion may include a first side portion extending parallel to the width direction; a second side portion opposing the first side portion in the height direction on the other side in the height direction and extending parallel to the width direction; a third side portion connected to one end of the first side portion located on the one side in the width direction, the third side portion extending toward the other side in the height direction as extending outward in the width direction; a fourth side portion connected to one end of the second side portion located on the one side in the width direction, the fourth side portion extending toward the one side in the height direction as extending outward in the width direction; a fifth side portion connected to the other end of the first side portion located on the other side in the width direction, the fifth side portion extending toward the other side in the height direction as extending outward in the width direction; and a sixth side portion connected to the other end of the second side portion located on the other side in the width direction, the sixth side portion extending toward the one side in the height direction as extending outward in the width direction.

In this case, a first corner portion may be provided at a connection portion between the first side portion and the third side portion, and a second corner portion may be provided at a connection portion between the second side portion and the fourth side portion. A third corner portion may be provided at a connection portion between the first side portion and the fifth side portion. A fourth corner portion may be provided at a connection portion between the second side portion and the sixth side portion.

In this case, when the gusset sheet portion and the front sheet portion are viewed from the front side in the pre-filling state, in a case where a first virtual line parallel to the height direction is drawn extending from the first intersection point at which the inner line of the first side-end joining portion and the inner line of the second joining portion intersect toward the one side in the height direction, the first virtual line may pass through the first corner portion and the second corner portion; in addition, in a case where a second virtual line parallel to the height direction is drawn extending from the second intersection point at which the inner line of the second side-end joining portion and the inner line of the second joining portion intersect toward the one side in the height direction, the second virtual line may pass through the third corner portion and the fourth corner portion.

In the pouch container according to the present disclosure, when the gusset sheet portion is viewed from the front side in the pre-filling state, an outer edge of the gusset sheet portion may include a first side portion extending parallel to the width direction; a second side portion opposing the first side portion in the height direction on the other side in the height direction and extending parallel to the width direction; a third side portion connected to one end of the first side portion located on the one side in the width direction, the third side portion extending toward the other side in the height direction as extending outward in the width direction; a fourth side portion connected to one end of the second side portion located on the one side in the width direction, the fourth side portion extending toward the one side in the height direction as extending outward in the width direction; a fifth side portion connected to the other end of the first side portion located on the other side in the width direction, the fifth side portion extending toward the other side in the height direction as extending outward in the width direction; and a sixth side portion connected to the other end of the second side portion located on the other side in the width direction, the sixth side portion extending toward the one side in the height direction as extending outward in the width direction.

In this case, a first corner portion being rounded may be provided at a connection portion between the first side portion and the third side portion, and a second corner portion being rounded may be provided at a connection portion between the second side portion and the fourth side portion. A third corner portion being rounded may be provided at a connection portion between the first side portion and the fifth side portion. A fourth corner portion being rounded may be provided at a connection portion between the second side portion and the sixth side portion.

The first corner portion preferably includes a first corner start point located on the one side in the width direction and a first corner end point located on the other side in the width direction. The second corner portion preferably includes a second corner start point located on the one side in the width direction and a second corner end point located on the other side in the width direction. The third corner portion preferably includes a third corner start point located on the one side in the width direction and a third corner end point located on the other side in the width direction. The fourth corner portion preferably includes a fourth corner start point located on the one side in the width direction and a fourth corner end point located on the other side in the width direction. Further, the second end portion of each of the front sheet portion and the back sheet portion may include corner portions at both ends in the width direction.

In this case, when the gusset sheet portion and the front sheet portion are viewed from the front side in the pre-filling state, at least part of the corner portion of the second end portion located on the one side in the width direction is preferably located between a third virtual line connecting the first corner start point and the second corner start point and extending toward the other side in the height direction, and a fourth virtual line connecting the first corner end point and the second corner end point and extending toward the other side in the height direction; in addition, at least part of the corner portion of the second end portion located on the other side in the width direction is preferably located between a fifth virtual line connecting the third corner start point and the fourth corner start point and extending toward the other side in the height direction, and a sixth virtual line connecting the third corner end point and the fourth corner end point and extending toward the other side in the height direction.

Advantageous Effects of Invention

According to the present disclosure, it is possible to provide a pouch container capable of suppressing variation in width in a height direction with a configuration in which a gusset sheet portion is provided on one side in the height direction, and an end portion of a front sheet portion and an end portion of a back sheet portion are directly joined to each other on the other side in the height direction.

DESCRIPTION OF EMBODIMENTS

Figure 1:
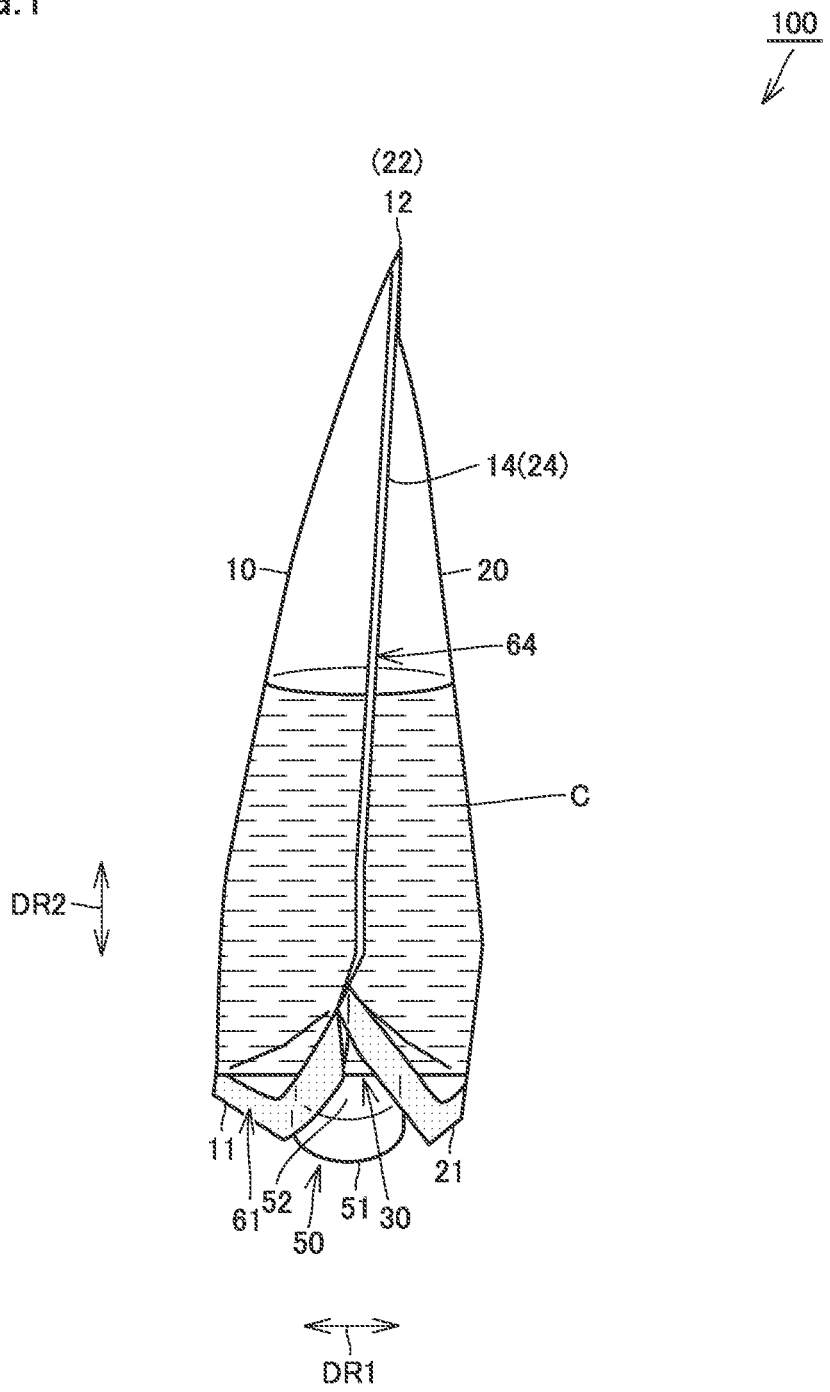
FIG. 1 is a schematic side view of a pouch container according to a first embodiment illustrating a state in which the pouch container is filled with contents.

Hereinafter, embodiments of the present disclosure will be described in detail with reference to the drawings. Note that in the embodiments illustrated below, identical or common portions are denoted by the same reference signs in the drawings, and description thereof will not be repeated.

First Embodiment

Figure 2:
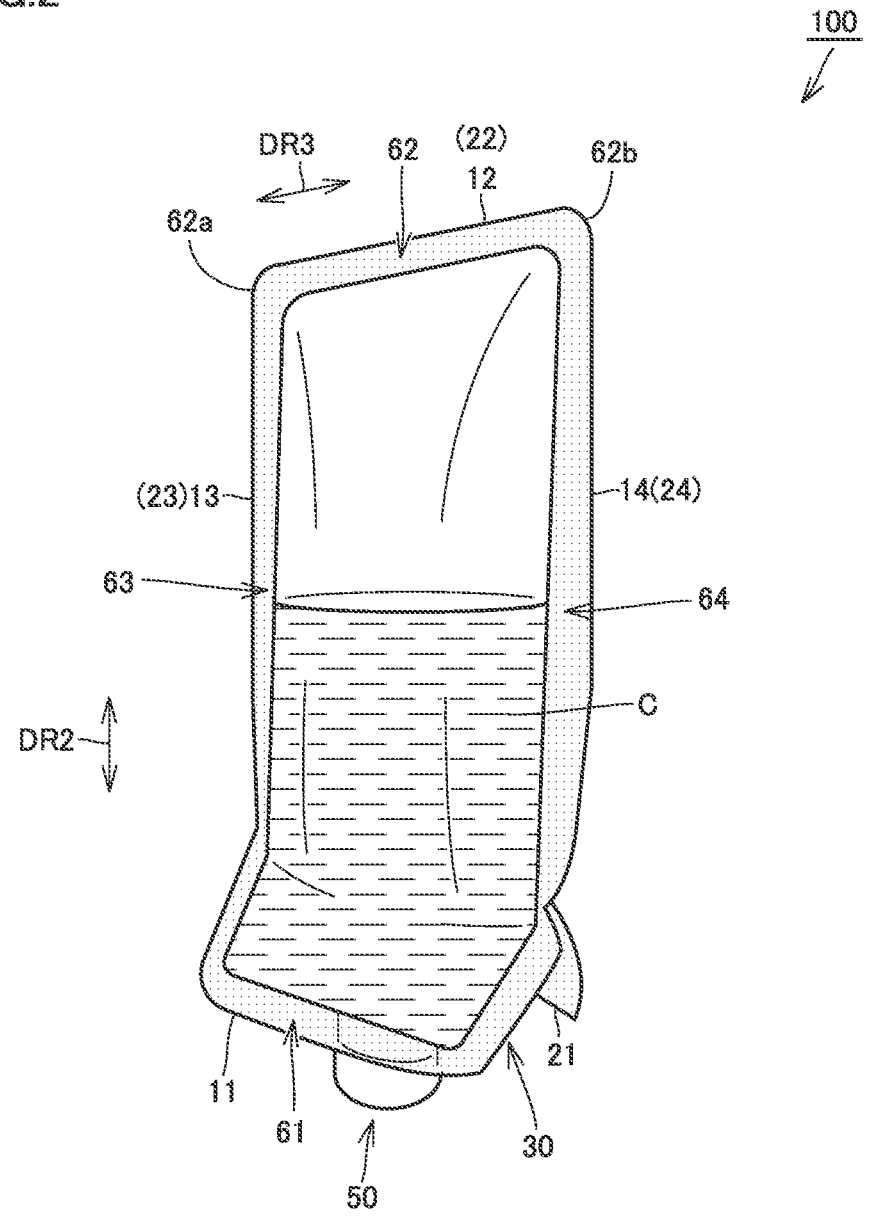
FIG. 2 is a schematic perspective view of the pouch container according to the first embodiment illustrating a state in which the pouch container is filled with contents.

FIG. 1 and FIG. 2 are a schematic side view and a schematic perspective view, respectively, of a pouch container according to a first embodiment illustrating a state in which the pouch container is filled with contents. A pouch container 100 according to the first embodiment will be described with reference to FIGS. 1 and 2.

As illustrated in FIGS. 1 and 2, the pouch container 100 includes a front sheet portion a back sheet portion 20, a gusset sheet portion 30, a spout 50, a first joining portion 61, a second joining portion 62, a first side-end joining portion 63, and a second side-end joining portion 64.

The front sheet portion 10 and the back sheet portion 20 face each other in a front-rear direction (DR1 direction). The front sheet portion 10 constitutes a front face side of the pouch container 100. The front sheet portion 10 includes a first end portion 11, a second end portion 12, a first side end portion 13, and a second side end portion 14.

The first end portion 11 is located on one side in a height direction (DR2 direction) orthogonal to the front-rear direction. The second end portion 12 is located on the other side in the height direction. The first side end portion 13 is located on one side in a width direction (DR3 direction) orthogonal to the front-rear direction and the height direction. The second side end portion 14 is located on the other side in the width direction.

The back sheet portion 20 constitutes a back face side of the pouch container 100. The back sheet portion 20 includes a first end portion 21, a second end portion 22, a first side end portion 23, and a second side end portion 24.

The first end portion 21 is located on the one side in the height direction. The second end portion 22 is located on the other side in the height direction. The first side end portion 23 is located on the one side in the width direction. The second side end portion 24 is located on the other side in the width direction.

The gusset sheet portion 30 constitutes part of the pouch container 100 on the one side in the height direction. The gusset sheet portion 30 includes an outer principal surface facing an outer side of the pouch container 100 (see FIG. 3).

The gusset sheet portion 30 is connected to the front sheet portion 10 and the back sheet portion 20 on the one side in the height direction. Specifically, the peripheral portion of the gusset sheet portion 30 is joined to the first end portion 11 of the front sheet portion and the first end portion 21 of the back sheet portion 20 by the first joining portion 61 having an annular shape. In a state in which contents C described later are stored in a storage space, the first end portion 11 and the first end portion 21 are located at substantially identical height positions.

The first joining portion 61 includes a one-side end portion 61*a* (see FIG. 3) located on the one side in the width direction and an other-side end portion 61*b* (see FIG. 3) located on the other side in the width direction.

The second end portion 12 of the front sheet portion 10 and the second end portion 22 of the back sheet portion 20 are directly joined to each other by the second joining portion 62. The second joining portion 62 includes a one-side end portion 62*a* located on the one side in the width direction, and an other-side end portion 62*b* located on the other side in the width direction.

The first side end portion 13 of the front sheet portion 10 and the first side end portion 23 of the back sheet portion 20 are joined to each other by the first side-end joining portion 63. The first side-end joining portion 63 is provided connecting the one-side end portion 61*a* of the first joining portion 61 and the one-side end portion 62*a* of the second joining portion 62.

The second side end portion 14 of the front sheet portion 10 and the second side end portion 24 of the back sheet portion 20 are joined by the second side-end joining portion 64. The second side-end joining portion 64 is provided connecting the other-side end portion 61*b* of the first joining portion 61 and the other-side end portion 62*b* of the second joining portion 62.

A storage space for storing contents is formed between the front sheet portion 10 and the back sheet portion 20. Specifically, a space surrounded by the front sheet portion 10, the back sheet portion 20, and the gusset sheet portion 30 functions as the storage space. The contents C are stored in the storage space. The contents C are, for example, in a liquid, granular, or powdery form.

The front sheet portion 10, the back sheet portion 20, and the gusset sheet portion 30 are each made of a resin sheet, for example. The resin sheet may be made of a single-layer resin film or a plurality of resin films.

The resin film constituting the resin sheet is required to have basic performance, such as impact resistance, wear resistance, and heat resistance, as a packaging body. When the above-described various joining portions are formed by a welding method such as heat sealing, ultrasonic sealing, or high-frequency sealing, the resin film is required to have heat sealing properties as well.

Suitable examples of the resin sheet include a multilayer resin sheet including a base film and a sealant layer that imparts heat sealing properties. When high gas barrier properties or light-blocking properties are required, a barrier layer is preferably provided between the base film and the sealant layer. Barrier properties may be imparted to the base film itself. In this case, the barrier layer is used as the base film, and the multilayer resin sheet includes the barrier layer and the sealant layer.

For the base film, for example, a film sheet material made of a polyester resin, polyolefin resin, or polyamide resin may be employed. For the sealant layer, for example, a film sheet material containing a polyolefin resin as a main ingredient may be employed.

For the barrier layer, a metal thin film made of aluminum or the like, a resin film made of vinylidene chloride (PVDC), an ethylene-vinyl alcohol copolymer (EVOH) or the like, or a film in which aluminum, inorganic oxide such as aluminum oxide or silica are layered on any synthetic resin film may be employed.

The various joining portions may be formed by an adhesive or the like instead of being formed by welding. The resin sheet may be provided with a design layer. The design layer may be provided on the outer surface of the base film or may be provided on the inner surface thereof, for example.

The spout 50 is provided in the gusset sheet portion 30. The spout 50 includes a lid 51, a body portion 52, and a flange portion 53 (see FIG. 3). The body portion 52 has a substantially cylindrical shape. The body portion 52 is provided extending through the gusset sheet portion 30. The flange portion 53 is provided extending radially outward of the body portion 52 from the base of the body portion 52. The flange portion 53 is provided in a flat ring shape, for example. The flange portion 53 is joined to an inner principal surface of the gusset sheet portion 30. The flange portion 53 may be joined to the outer principal surface 30*a* of the gusset sheet portion 30. The lid 51 closes the tip of the body portion 52 in an openable and closable manner.

Figure 3:
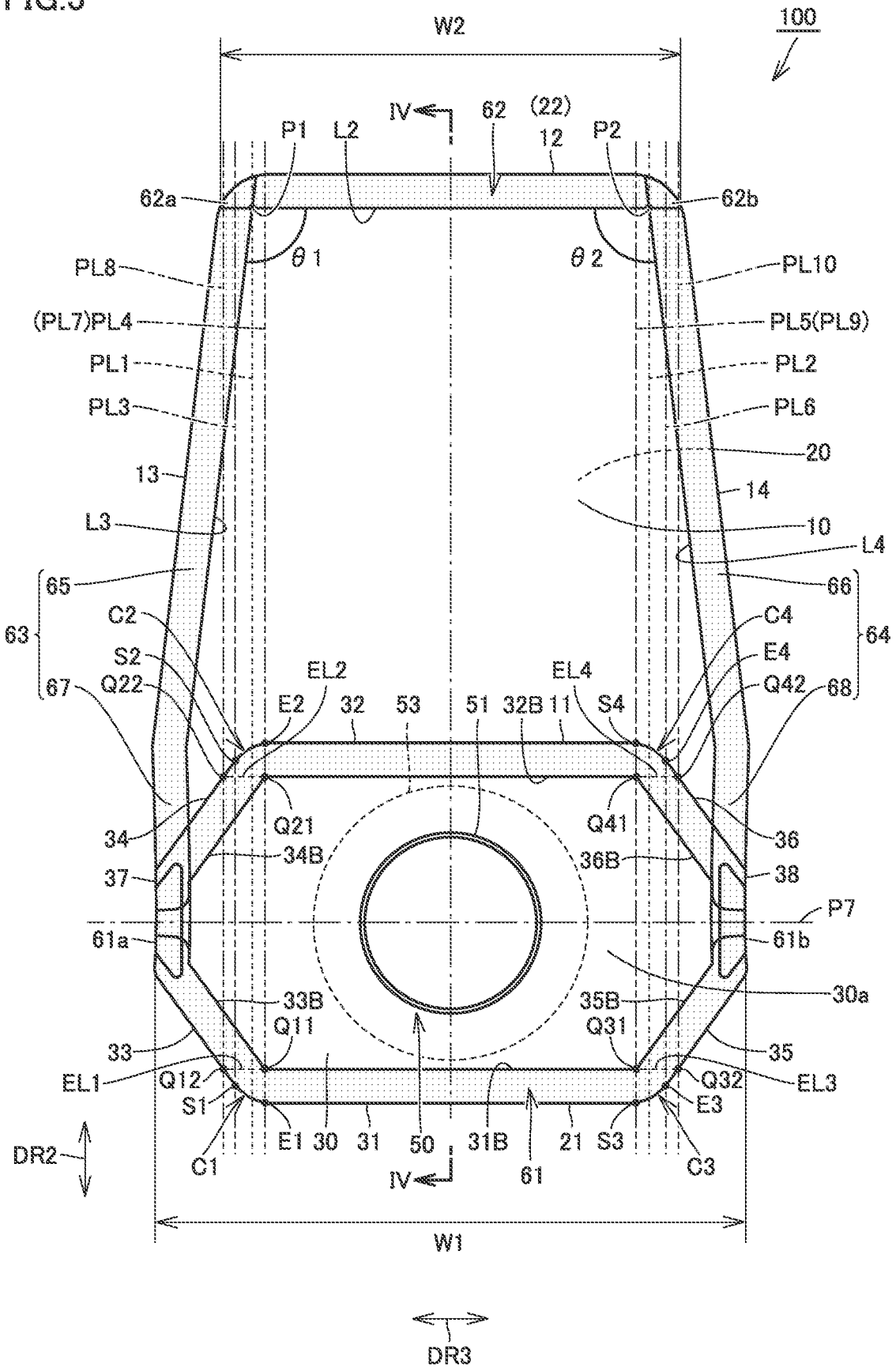
FIG. 3 is a front view of the pouch container according to the first embodiment illustrating a state before the pouch container is filled with contents.
Figure 4:
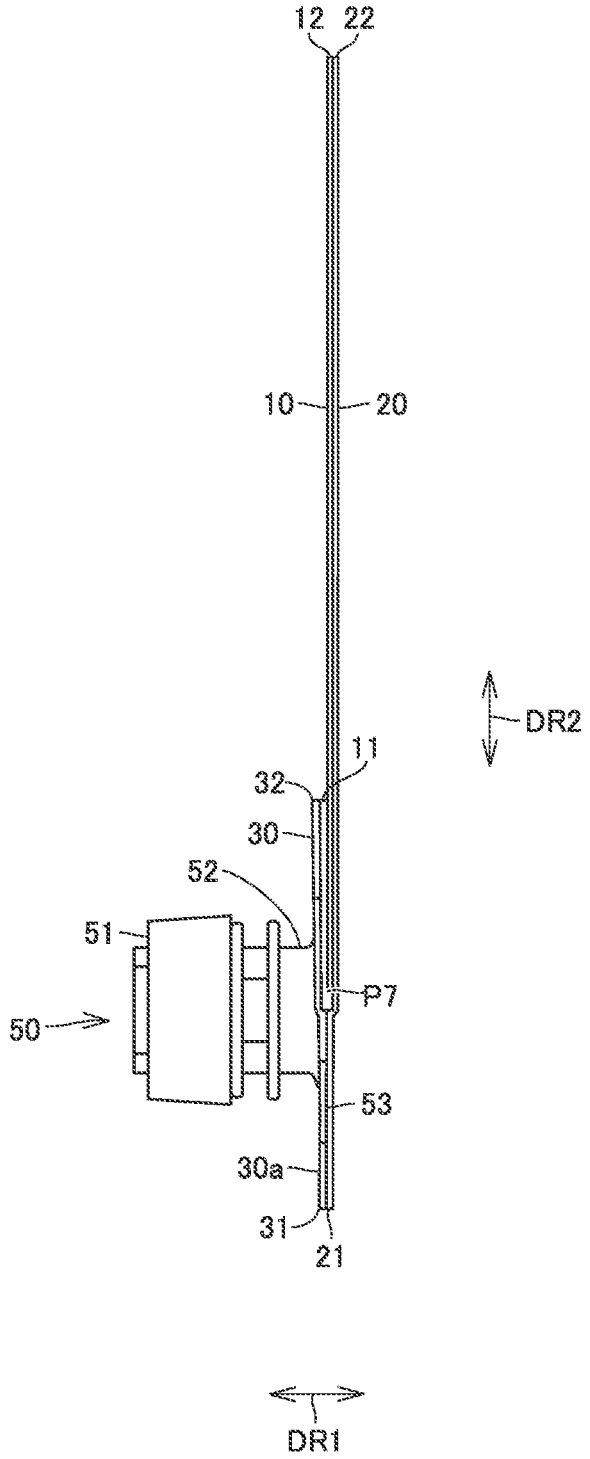
FIG. 4 is a schematic cross-sectional view taken along a line IV-IV indicated in FIG. 3.

FIG. 3 is a front view of the pouch container according to the first embodiment illustrating a state before the pouch container is filled with contents. FIG. 4 is a schematic cross-sectional view taken along a line IV-IV indicated in FIG. 3.

Specifically, FIG. 3 illustrates the front view of the pouch container 100 viewed from the front side in a pre-filling state (first state) in which the storage space formed between the front sheet portion 10 and the back sheet portion 20 is not filled with contents and the gusset sheet portion 30 is arranged overlapping the back sheet portion in the front-rear direction with the outer principal surface 30*a* of the gusset sheet portion 30 facing the front side, as illustrated in FIG. 4. In other words, FIG. 3 illustrates a plan view of the pouch container 100 in the first state.

As illustrated in FIG. 4, in the first state, on the one side in the height direction, part of the front sheet portion 10 is folded back toward the other side in the height direction at a folding line P7. As a result, in the first state, the first end portion 11 of the front sheet portion 10 is located on the other side in the height direction relative to the first end portion 21 of the back sheet portion 20. Note that the folding line P7 is a virtual line extending along the width direction. The folding line P7 is a virtual line connecting intersection points on both sides in the width direction of the front sheet portion 10, the back sheet portion 20, and the gusset sheet portion 30.

Hereinafter, in the description regarding FIG. 3, the state of the pouch container 100 when the gusset sheet portion 30 and the front sheet portion are viewed from the front side in the first state will be described.

Referring again to FIG. 3, a width W1 of the gusset sheet portion 30 is greater than a width W2 of the second joining portion 62. The width W2 of the second joining portion 62 is substantially identical to the widths of the second end portions 12 and 22.

The above-described first side-end joining portion 63 includes a first inclined portion 65 and a connection portion 67. The first inclined portion 65 is connected to the one-side end portion 62*a* of the second joining portion 62. The first inclined portion 65 is inclined outward in the width direction (specifically, toward the one side in the width direction) as extending from the one-side end portion 62*a* toward the one side in the height direction.

An angle θ1 on the storage space side of the angles formed by the first inclined portion 65 and the second joining portion 62 is preferably larger than 90 degrees and equal to or smaller than 110 degrees. More preferably, the angle θ1 is larger than 90 degrees and equal to or smaller than 100 degrees.

The connection portion 67 connects an end portion of the first inclined portion 65 located on the one side in the height direction, and the one-side end portion 61*a* of the first joining portion 61. The connection portion 67 may be slightly inclined outward in the width direction (toward the one side in the width direction) as extending toward the one side in the height direction. In this case, the smaller angle of the angles formed by a virtual line parallel to the height direction and the connection portion 67 is smaller than the smaller angle of the angles formed by a virtual line parallel to the height direction and the first inclined portion 65.

Since the connection portion 67 is inclined as described above, fluidity of the contents C may be increased when the contents C are discharged to the outside through the spout 50.

The connection portion 67 may be omitted, and the end portion of the first inclined portion 65 located on the one side in the height direction may be connected to the one-side end portion 61*a* of the first joining portion 61. The connection portion 67 may be provided linearly to be parallel to the height direction without being inclined.

The second side-end joining portion 64 includes a second inclined portion 66 and a connection portion 68. The second inclined portion 66 is connected to the other-side end portion 62*b* of the second joining portion 62. The second inclined portion 66 is inclined outward in the width direction (specifically, toward the other side in the width direction) as extending from the other-side end portion 62*b* toward the one side in the height direction.

An angle θ2 on the storage space side of the angles formed by the second inclined portion 66 and the second joining portion 62 is preferably larger than 90 degrees and equal to or smaller than 110 degrees. More preferably, the angle θ2 is larger than 90 degrees and equal to or smaller than 100 degrees.

The connection portion 68 connects an end portion of the second inclined portion 66 located on the one side in the height direction, and the other-side end portion 61*b* of the first joining portion 61. The connection portion 68 may be slightly inclined outward in the width direction (toward the other side in the width direction) as extending toward the one side in the height direction. In this case, the smaller angle of the angles formed by a virtual line parallel to the height direction and the connection portion 68 is smaller than the smaller angle of the angles formed by a virtual line parallel to the height direction and the second inclined portion 66.

Since the connection portion 68 is inclined as described above, fluidity of the contents C may be increased when the contents C are discharged to the outside through the spout 50.

The connection portion 68 may be omitted, and the end portion of the second inclined portion 66 located on the one side in the height direction may be connected to the other-side end portion 61*b* of the first joining portion 61. The connection portion 68 may be provided linearly to be parallel to the height direction without being inclined.

The gusset sheet portion 30 has an octagonal shape. The outer edge of the gusset sheet portion 30 includes a first side portion 31, a second side portion 32, a third side portion 33, a fourth side portion 34, a fifth side portion 35, a sixth side portion 36, a seventh side portion 37, and an eighth side portion 38.

The first side portion 31 extends parallel to the width direction. The first side portion 31 is located on the one side in the height direction. The second side portion 32 opposes the first side portion 31 in the height direction on the other side in the height direction. The length of the first side portion 31 in the width direction is substantially identical to the length of the second side portion 32 in the width direction.

The third side portion 33 is connected to one end of the first side portion 31 located on the one side in the width direction. The third side portion 33 extends toward the other side in the height direction as extending outward in the width direction (more specifically, toward the one side in the width direction).

The fourth side portion 34 is connected to one end of the second side portion 32 located on the one side in the width direction. The fourth side portion 34 extends toward the one side in the height direction as extending outward in the width direction (more specifically, toward the one side in the width direction).

The fifth side portion 35 is connected to the other end of the first side portion 31 located on the other side in the width direction. The fifth side portion extends toward the other side in the height direction as extending outward in the width direction (more specifically, toward the other side in the width direction).

The sixth side portion 36 is connected to the other end of the second side portion located on the other side in the width direction. The sixth side portion extends toward the one side in the height direction as extending outward in the width direction (more specifically, toward the other side in the width direction).

The seventh side portion 37 connects an end portion of the third side portion 33 located on the one side in the width direction, and an end portion of the fourth side portion 34 located on the one side in the width direction. The seventh side portion 37 extends substantially parallel to the height direction.

The eighth side portion 38 connects an end portion of the fifth side portion 35 located on the other side in the width direction, and an end portion of the sixth side portion 36 located on the other side in the width direction. The eighth side portion 38 opposes the seventh side portion 37 in the width direction and extends substantially parallel to the height direction.

When the gusset sheet portion 30 is formed in a hexagonal shape, the seventh side portion 37 and the eighth side portion 38 may be omitted. In this case, the third side portion 33 and the fourth side portion 34 are directly connected to each other, and the fifth side portion 35 and the sixth side portion 36 are directly connected to each other.

A first corner portion C1 being rounded is provided at a connection portion between the first side portion 31 and the third side portion 33. The first corner portion C1 includes a first corner start point S1 located on the one side in the width direction, and a first corner end point E1 located on the other side in the width direction.

A second corner portion C2 being rounded is provided at a connection portion between the second side portion 32 and the fourth side portion 34. The second corner portion C2 includes a second corner start point S2 located on the one side in the width direction, and a second corner end point E2 located on the other side in the width direction.

A third corner portion C3 being rounded is provided at a connection portion between the first side portion 31 and the fifth side portion 35. The third corner portion C3 includes a third corner start point S3 located on the one side in the width direction, and a third corner end point E3 located on the other side in the width direction.

A fourth corner portion C4 being rounded is provided at a connection portion between the second side portion 32 and the sixth side portion 36. The fourth corner portion C4 includes a fourth corner start point S4 located on the one side in the width direction, and a fourth corner end point E4 located on the other side in the width direction.

An inner line L3 of the first side-end joining portion 63 and an inner line L2 of the second joining portion 62 intersect at a first intersection point P1. An inner line L4 of the second side-end joining portion 64 and the inner line L2 of the second joining portion 62 intersect at a second intersection point P2.

When a first virtual line PL1 parallel to the height direction is drawn extending from the first intersection point P1 toward the one side in the height direction, the first virtual line PL1 intersects the first corner portion C1 and the second corner portion C2. In other words, the first virtual line PL1 passes through the first corner portion C1 and the second corner portion C2.

When a second virtual line PL2 parallel to the height direction is drawn extending from the second intersection point P2 toward the one side in the height direction, the second virtual line PL2 intersects the third corner portion C3 and the fourth corner portion C4. In other words, the second virtual line PL2 passes through the third corner portion C3 and the fourth corner portion C4.

At least part of the one-side end portion 62*a* of the second joining portion 62 is located between a third virtual line PL3 connecting the first corner start point S1 and the second corner start point S2 and extending toward the other side in the height direction, and a fourth virtual line PL4 connecting the first corner end point E1 and the second corner end point E2 and extending toward the other side in the height direction.

At least part of the other-side end portion 62*b* of the second joining portion 62 is located between a fifth virtual line PL5 connecting the third corner start point S3 and the fourth corner start point S4 and extending toward the other side in the height direction, and a sixth virtual line PL6 connecting the third corner end point E3 and the fourth corner end point E4 and extending toward the other side in the height direction.

The first joining portion 61 having an annular shape includes a first inner line 31B, a second inner line 32B, a third inner line 33B, a fourth inner line 34B, a fifth inner line 35B, and a sixth inner line 36B.

The first inner line 31B is located on the inner side of the first side portion 31 and is provided facing the first side portion 31. The first inner line 31B extends along a direction parallel to the extending direction of the first side portion 31.

The second inner line 32B is located on the inner side of the second side portion 32 and is provided facing the second side portion 32. The second inner line 32B extends along a direction parallel to the extending direction of the second side portion 32.

The third inner line 33B is located on the inner side of the third side portion 33 and is provided facing the third side portion 33. The third inner line 33B extends along a direction parallel to the extending direction of the third side portion 33.

The fourth inner line 34B is located on the inner side of the fourth side portion 34 and is provided facing the fourth side portion 34. The fourth inner line 34B extends along a direction parallel to the extending direction of the fourth side portion 34.

The fifth inner line 35B is located on the inner side of the fifth side portion 35 and is provided facing the fifth side portion 35. The fifth inner line 35B extends along a direction parallel to the extending direction of the fifth side portion 35.

The sixth inner line 36B is located on the inner side of the sixth side portion 36 and is provided facing the sixth side portion 36. The sixth inner line 36B extends along a direction parallel to the extending direction of the sixth side portion 36.

The first inner line 31B and the third inner line 33B intersect at a first inner intersection point Q11. The first inner line 31B and the third inner line 33B are connected to each other at the first inner intersection point Q11.

A first extension line EL1 obtained by extending the first inner line 31B outward in the width direction (toward the one side in the width direction) from the first inner intersection point Q11 intersects the third side portion 33 at a first outer intersection point Q12.

The second inner line 32B and the fourth inner line 34B intersect at a second inner intersection point Q21. The second inner line 32B and the fourth inner line 34B are connected to each other at the second inner intersection point Q21.

A second extension line EL2 obtained by extending the second inner line 32B outward in the width direction (toward the one side in the width direction) from the second inner intersection point Q21 intersects the fourth side portion 34 at a second outer intersection point Q22.

The first inner line 31B and the fifth inner line 35B intersect at a third inner intersection point Q31. The first inner line 31B and the fifth inner line 35B are connected to each other at the third inner intersection point Q31.

A third extension line EL3 obtained by extending the first inner line 31B outward in the width direction (toward the other side in the width direction) from the third inner intersection point Q31 intersects the fifth side portion 35 at a third outer intersection point Q32.

The second inner line 32B and the sixth inner line 36B intersect at a fourth inner intersection point Q41. The second inner line 32B and the sixth inner line 36B are connected to each other at the fourth inner intersection point Q41.

A fourth extension line EL4 obtained by extending the second inner line 32B outward in the width direction (toward the other side in the width direction) from the fourth inner intersection point Q41 intersects the sixth side portion 36 at a fourth outer intersection point Q42.

In this case, the first virtual line PL1 is located between a first inner virtual line PL7 connecting the first inner intersection point Q11 and the second inner intersection point Q21 and extending toward the other side in the height direction, and a first outer virtual line PL8 connecting the first outer intersection point Q12 and the second outer intersection point Q22 and extending toward the other side in the height direction; in addition, the second virtual line PL2 is located between a second inner virtual line PL9 connecting the third inner intersection point Q31 and the fourth inner intersection point Q41 and extending toward the other side in the height direction, and a second outer virtual line PL10 connecting the third outer intersection point Q32 and the fourth outer intersection point Q42 and extending toward the other side in the height direction.

At least part of the one-side end portion 62*a* of the second joining portion 62 is located between the first inner virtual line PL7 and the first outer virtual line PL8, and at least part of the other-side end portion 62*b* of the second joining portion 62 is located between the second inner virtual line PL9 and the second outer virtual line PL10.

In the present embodiment, the case where the first inner virtual line PL7 matches the fourth virtual line PL4 and the second inner virtual line PL9 matches the fifth virtual line PL5 has been illustrated as an example. However, the first inner virtual line PL7 need not match the fourth virtual line PL4 and the second inner virtual line PL9 need not match the fifth virtual line PL5.

Figure 5:
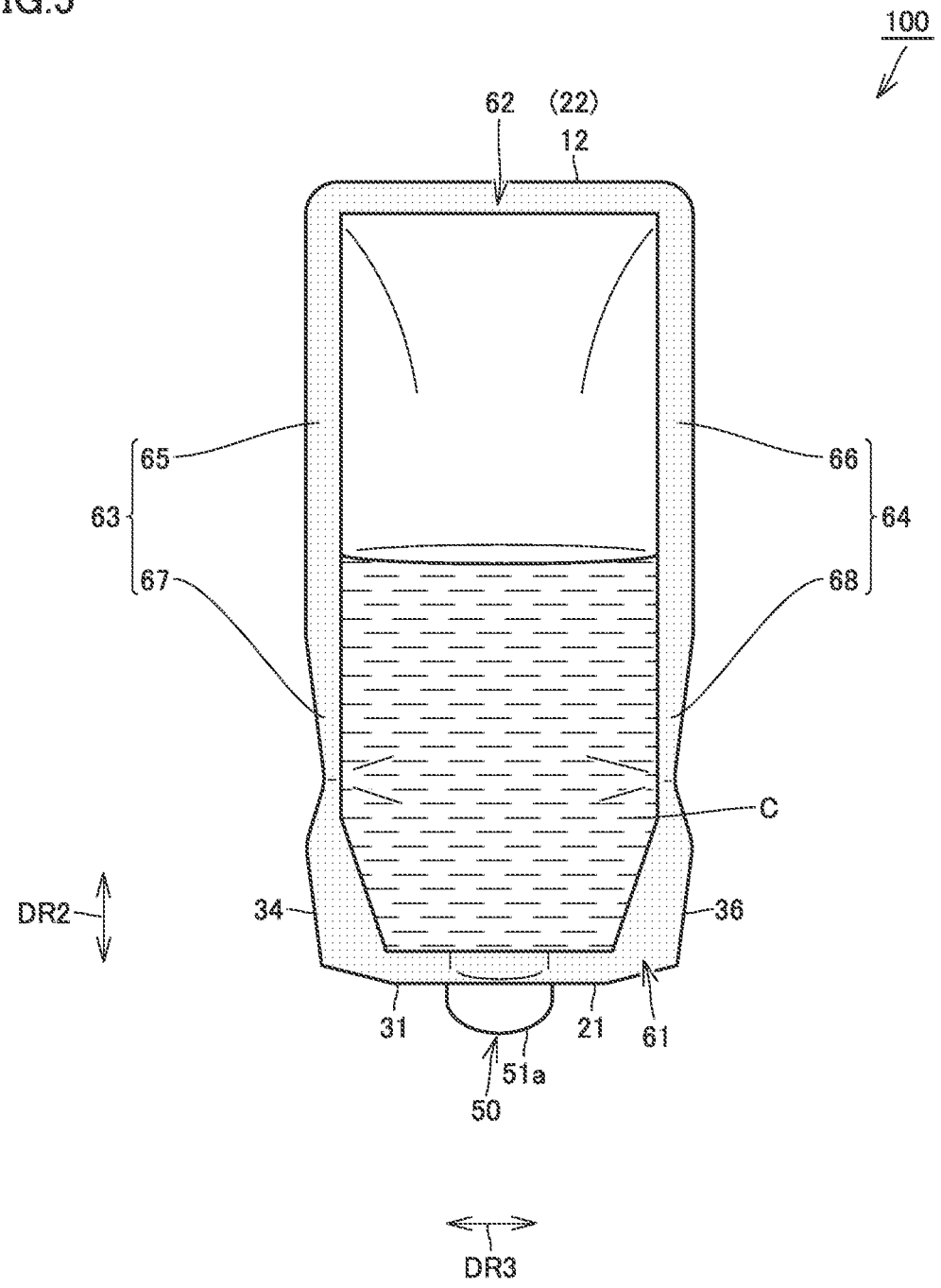
FIG. 5 is a schematic front view of the pouch container according to the first embodiment illustrating a state in which the pouch container is filled with contents.

FIG. 5 is a schematic front view of the pouch container according to the first embodiment illustrating a state in which the pouch container is filled with contents.

As described above, in the pouch container 100 according to the first embodiment, the gusset sheet portion 30 is provided on the one side in the height direction, and in the other side in the height direction, the second end portion 12 of the front sheet portion 10 and the second end portion 22 of the back sheet portion 20 are directly joined by the second joining portion 62. When viewed from the front in the first state, the width W1 of the gusset sheet portion 30 is larger than the width W2 of the second joining portion 62 (or the second end portions 12 and 22), the first side-end joining portion 63 includes the first inclined portion 65, and the second side-end joining portion 64 includes the second inclined portion 66.

Therefore, as illustrated in FIG. 5, in the post-filling state (second state) in which the storage space is filled with the contents C and the gusset sheet portion 30 (more specifically, the outer principal surface 30*a*) faces the one side in the height direction, the first inclined portion 65 and the second inclined portion 66 extend along the height direction. As a result, in the state in which the storage space is filled with the contents C, it is possible to suppress variation in width in the height direction. In addition, the appearance of the pouch container 100 may be improved.

That the first inclined portion 65 and the second inclined portion 66 extend along the height direction encompasses not only a case where the first inclined portion 65 and the second inclined portion 66 are parallel to the height direction but also a case where the first inclined portion 65 and the second inclined portion 66 are very slightly inclined with respect to the height direction. For example, the first inclined portion and the second inclined portion may be inclined with respect to the height direction in a range from approximately minus 5 degrees to approximately plus 5 degrees.

When, as viewed from the front in the first state, the angle θ1 and the angle θ2 are greater than 90 degrees and equal to or smaller than 110 degrees, the first inclined portion 65 and the second inclined portion 66 easily move along the height direction when the storage space is filled with the contents C.

As described above, when, as viewed from the front in the first state, the first virtual line PL1 is located between the first inner virtual line PL7 and the second outer virtual line PL8, and the second virtual line PL2 is located between the second inner virtual line PL9 and the second outer virtual line PL10, the first inclined portion 65 and the second inclined portion 66 easily move along the height direction when the storage space is filled with the contents C.

When, as viewed from the front in the first state, at least part of the one-side end portion 62*a* of the second joining portion 62 is located between the first inner virtual line PL7 and the first outer virtual line PL8, and at least part of the other-side end portion 62*b* of the second joining portion 62 is located between the second inner virtual line PL9 and the second outer virtual line PL10, the first inclined portion 65 and the second inclined portion 66 easily move along the height direction when the storage space is filled with the contents C.

In addition, as discussed above, when, as viewed from the front in the first state, the first virtual line PL1 intersects the first corner portion C1 and the second corner portion C2, and the second virtual line PL2 intersects the third corner portion C3 and the fourth corner portion C4, the first inclined portion 65 and the second inclined portion 66 easily move along the height direction when the storage space is filled with the contents C.

As discussed above, when, as viewed from the front in the first state, at least part of the one-side end portion 62*a* of the second joining portion 62 is located between the third virtual line PL3 and the fourth virtual line PL4, and at least part of the other-side end portion 62*b* of the second joining portion 62 is located between the fifth virtual line PL5 and the sixth virtual line PL6, the first inclined portion 65 and the second inclined portion 66 easily move along the height direction when the storage space is filled with the contents C.

When a planar portion 51*a* of the lid 51 of the spout 50 is placed at a predetermined placement position with the outer principal surface 30*a* of the gusset sheet portion 30 facing downward, the pouch container 100 may be maintained in an upright state. As described above, when the pouch containers are displayed side by side on a display shelf in a store with the first inclined portion 65 and the second inclined portion 66 being parallel to the height direction, the pouch containers may be efficiently arranged in a placement space.

Second Embodiment

Figure 6:
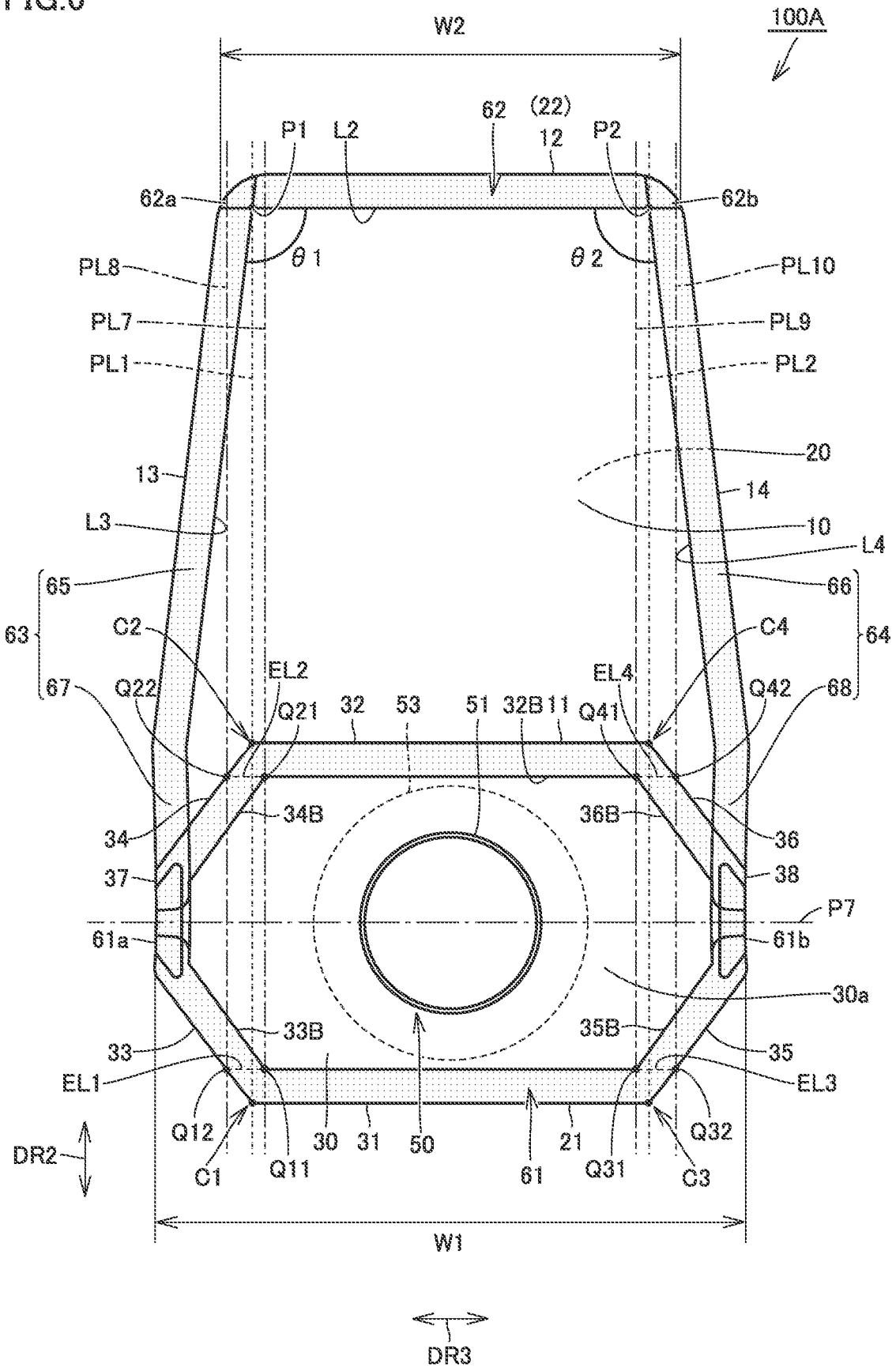
FIG. 6 is a front view of a pouch container according to a second embodiment illustrating a state before the pouch container is filled with contents.

FIG. 6 is a front view of a pouch container according to a second embodiment illustrating a state before the pouch container is filled with contents. A pouch container 100A according to the second embodiment will be described below with reference to FIG. 6.

As illustrated in FIG. 6, the pouch container 100A according to the second embodiment differs from the pouch container 100 according to the first embodiment in that a first corner portion C1 to a fourth corner portion C4 are not rounded but angular. The other configurations are substantially the same.

In the pouch container 100A according to the second embodiment as well, as described above, when viewed from the front in a first state, in a case where the first virtual line PL1 parallel to the height direction is drawn extending from the first intersection point P1 toward one side in a height direction, the first virtual line PL1 passes through the first corner portion C1 and the second corner portion C2; in addition, in a case where the second virtual line PL2 parallel to the height direction is drawn extending from the second intersection point P2 toward the one side in the height direction, the second virtual line PL2 passes through the third corner portion C3 and the fourth corner portion C4.

The first corner portion C1 and the second corner portion C2 are located between the first inner virtual line PL7 and the first outer virtual line PL8. The third corner portion C3 and the fourth corner portion C4 are located between the second inner virtual line PL9 and the second outer virtual line PL10.

The first virtual line PL1 is located between the first inner virtual line PL7 and the first outer virtual line PL8. The second virtual line PL2 is located between the second inner virtual line PL9 and the second outer virtual line PL10.

At least part of the one-side end portion 62*a* of the second joining portion 62 is located between the first inner virtual line PL7 and the first outer virtual line PL8. At least part of the other-side end portion 62*b* of the second joining portion 62 is located between the second inner virtual line PL9 and the second outer virtual line PL10.

In the above configuration as well, the pouch container 100A according to the second embodiment may achieve substantially the same effects as those of the first embodiment.

Third Embodiment

Figure 7:
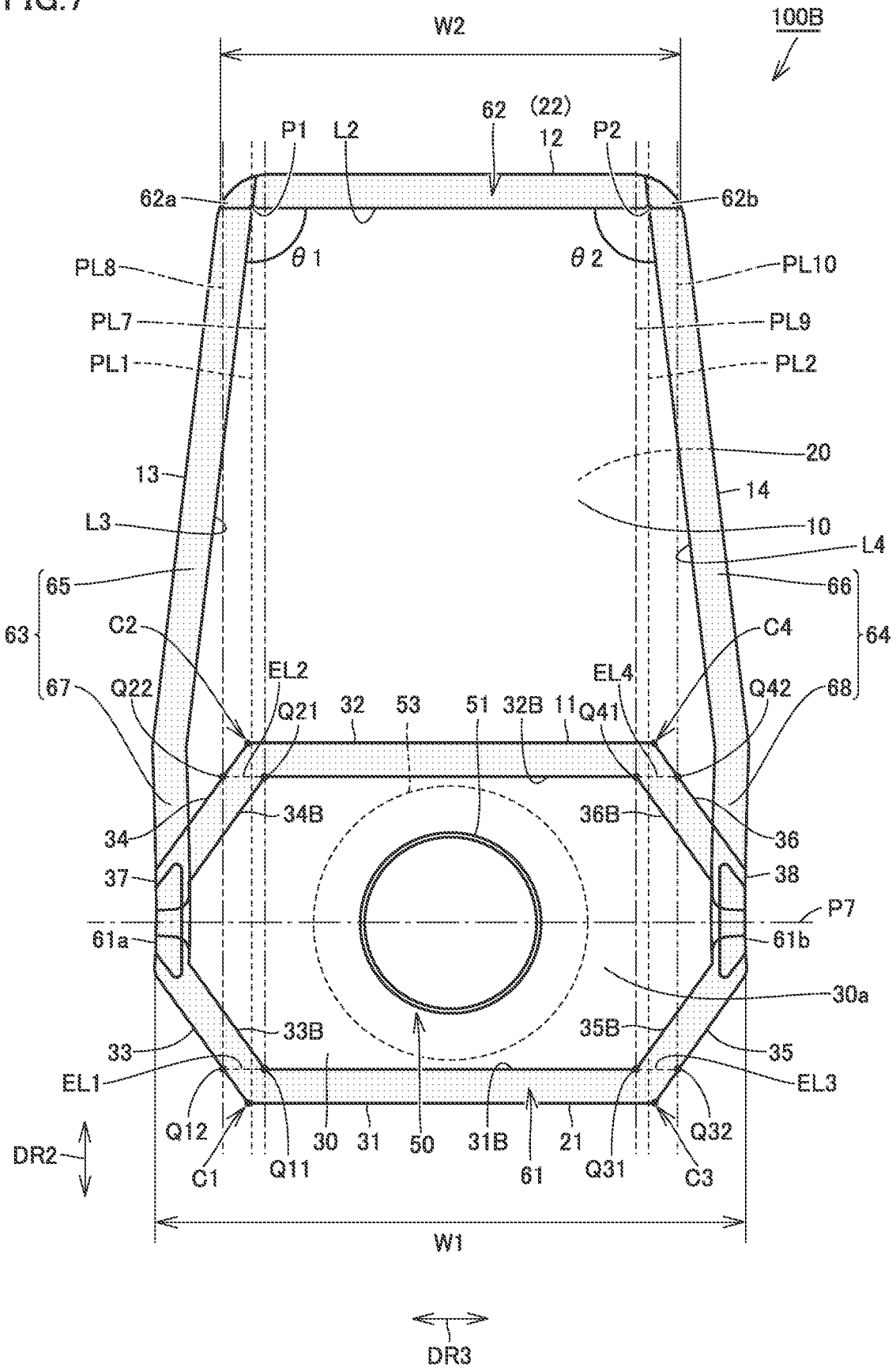
FIG. 7 is a front view of a pouch container according to a third embodiment illustrating a state before the pouch container is filled with contents.

FIG. 7 is a front view of a pouch container according to a third embodiment illustrating a state before the pouch container is filled with contents. A pouch container 100B according to the third embodiment will be described with reference to FIG. 7.

As illustrated in FIG. 7, the pouch container 100B according to the third embodiment differs from the pouch container 100A according to the second embodiment in that positions of a first corner portion C1 to a fourth corner portion C4 are different from those of the second embodiment. The other configurations are substantially the same.

The first corner portion C1 and the second corner portion C2 are each located at a position shifted from the first virtual line PL1 in a width direction. Specifically, the first corner portion C1 and the second corner portion C2 are each located outward in the width direction (on the one side in the width direction) relative to the first virtual line PL1.

The third corner portion C3 and the fourth corner portion C4 are each located at a position shifted from the second virtual line PL2 in the width direction. Specifically, the third corner portion C3 and the fourth corner portion C4 are each located outward in the width direction (on the other side in the width direction) relative to the second virtual line PL2.

The first corner portion C1 and the second corner portion C2 may be located on the inner side in the width direction relative to the first virtual line PL1. In this case, the third corner portion C3 and the fourth corner portion C4 are preferably also located on the inner side in the width direction relative to the second virtual line PL2.

In the pouch container 100B according to the third embodiment as well, as discussed above, when viewed from the front in a first state, the first virtual line PL1 is located between the first inner virtual line PL7 and the first outer virtual line PL8, and the second virtual line PL2 is located between the second inner virtual line PL9 and the second outer virtual line PL10.

At least part of the one-side end portion 62*a* of the second joining portion 62 is located between the first inner virtual line PL7 and the first outer virtual line PL8. At least part of the other-side end portion 62*b* of the second joining portion 62 is located between the second inner virtual line PL9 and the second outer virtual line PL10.

In the above configuration as well, the pouch container 100B according to the third embodiment may achieve substantially the same effects as those of the first embodiment.

In the first to third embodiments described above, the pouch containers 100, 100A, and 100B may be formed by a plurality of sheets being joined or may be formed by a single sheet being folded back and joined.

Note that the embodiments disclosed herein are illustrative and non-restrictive in any respect. The scope of the present invention is defined by the claims, and encompasses all modifications within the meanings and ranges equivalent to those of the claims.

REFERENCE SIGNS LIST

10 Front sheet portion
11 First end portion
12 Second end portion
13 First side end portion
14 Second side end portion
20 Back sheet portion
21 First end portion
22 Second end portion
23 First side end portion
24 Second side end portion
30 Gusset sheet portion
30*a* Outer principal surface
31 First side portion
32 Second side portion
33 Third side portion
34 Fourth side portion
35 Fifth side portion
36 Sixth side portion
37 Seventh side portion
38 Eighth side portion
31B First inner line
32B Second inner line
33B Third inner line
34B Fourth inner line
35B Fifth inner line
36B Sixth inner line
50 Spout
51 Lid
51*a* Planar portion
52 Body portion
53 Flange portion
61 First joining portion
61*a* One-side end portion
61*b* Other-side end portion
62 Second joining portion
62*a* One-side end portion
62*b* Other-side end portion
63 First side-end joining portion
64 Second side-end joining portion
65 First inclined portion
66 Second inclined portion
67, 68 Connection portion
100, 100A, 100B Pouch container
C Content
C1 First corner portion
C2 Second corner portion
C3 Third corner portion
C4 Fourth corner portion
C10, C11 Corner portion
E1 First corner end point
E2 Second corner end point
E3 Third corner end point
E4 Fourth corner end point
EL1 First extension line
EL2 Second extension line
EL3 Third extension line
EL4 Fourth extension line
L2, L3, L4 Inner line
P1 First intersection point
P2 Second intersection point
P7 Folding line
PL1 First virtual line
PL2 Second virtual line
PL3 Third virtual line
PL4 Fourth virtual line
PL5 Fifth virtual line
PL6 Sixth virtual line
PL7 First inner virtual line
PL8 First outer virtual line
PL9 Second inner virtual line
PL10 Second outer virtual line
Q11 First inner intersection point
Q12 First outer intersection point
Q21 Second inner intersection point
Q22 Second outer intersection point
Q31 Third inner intersection point
Q32 Third outer intersection point
Q41 Fourth inner intersection point
Q42 Fourth outer intersection point S1 First corner start point
S2 Second corner start point
S3 Third corner start point
S4 Fourth corner start point
W1, W2 Width

What is claimed is:

1. A pouch container, comprising:

a front sheet portion and a back sheet portion facing each other in a front-rear direction; and a gusset sheet portion connected to the front sheet portion and the back sheet portion on one side in a height direction orthogonal to the front-rear direction, wherein each of the front sheet portion and the back sheet portion includes a first end portion located on the one side in the height direction, a second end portion located on the other side in the height direction, a first side end portion located on one side in a width direction orthogonal to the front-rear direction and the height direction, and a second side end portion located on the other side in the width direction, the pouch container further includes:

a first joining portion connecting a peripheral portion of the gusset sheet portion to the first end portion of the front sheet portion and the first end portion of the back sheet portion in an annular shape, a second joining portion joining the second end portion of the front sheet portion and the second end portion of the back sheet portion, a first side-end joining portion provided connecting a one-side end portion of the first joining portion located on the one side in the width direction and a one-side end portion of the second joining portion located on the one side in the width direction, the first side-end joining portion joining the first side end portion of the front sheet portion and the first side end portion of the back sheet portion, and a second side-end joining portion provided connecting an other-side end portion of the first joining portion located on the other side in the width direction and an other-side end portion of the second joining portion located on the other side in the width direction, the second side-end joining portion joining the second side end portion of the front sheet portion and the second side end portion of the back sheet portion, when the gusset sheet portion and the front sheet portion are viewed from a front side in a pre-filling state in which a storage space formed between the front sheet portion and the back sheet portion is not filled with contents and the gusset sheet portion is arranged overlapping the back sheet portion in the front-rear direction with the gusset sheet portion facing the front side, a width of the gusset sheet portion in the width direction is larger than a width of the second joining portion in the width direction, and the first side-end joining portion includes a first inclined portion extending outward in the width direction as extending from the one-side end portion of the second joining portion toward the one side in the height direction, and the second side-end joining portion includes a second inclined portion extending outward in the width direction as extending from the other-side end portion of the second joining portion toward the one side in the height direction, and when the front sheet portion is viewed from the front side in a post-filling state in which the storage space is filled with contents and the gusset sheet portion faces the one side in the height direction, the first inclined portion and the second inclined portion extend along the height direction.

2. The pouch container according to claim 1, wherein when the gusset sheet portion and the front sheet portion are viewed from the front side in the pre-filling state, of angles formed by the first inclined portion and the second joining portion, the angle on a storage space side is larger than 90 degrees and equal to or smaller than 110 degrees, and of angles formed by the second inclined portion and the second joining portion, the angle on the storage space side is larger than 90 degrees and equal to or smaller than 110 degrees.

3. The pouch container according to claim 1, wherein when the gusset sheet portion is viewed from the front side in the pre-filling state, an outer edge of the gusset sheet portion includes:

a first side portion extending parallel to the width direction, a second side portion opposing the first side portion in the height direction on the other side in the height direction and extending parallel to the width direction, a third side portion connected to one end of the first side portion located on the one side in the width direction, the third side portion extending toward the other side in the height direction as extending outward in the width direction, a fourth side portion connected to one end of the second side portion located on the one side in the width direction, the fourth side portion extending toward the one side in the height direction as extending outward in the width direction, a fifth side portion connected to the other end of the first side portion located on the other side in the width direction, the fifth side portion extending toward the other side in the height direction as extending outward in the width direction, and a sixth side portion connected to the other end of the second side portion located on the other side in the width direction, the sixth side portion extending toward the one side in the height direction as extending outward in the width direction, the first joining portion includes:

a first inner line located on an inner side of the first side portion and extending along a direction parallel to the extending direction of the first side portion, a second inner line located on an inner side of the second side portion and extending along a direction parallel to the extending direction of the second side portion, a third inner line located on an inner side of the third side portion and extending along a direction parallel to the extending direction of the third side portion, a fourth inner line located on an inner side of the fourth side portion and extending along a direction parallel to the extending direction of the fourth side portion, a fifth inner line located on an inner side of the fifth side portion and extending along a direction parallel to the extending direction of the fifth side portion, and a sixth inner line located on an inner side of the sixth side portion and extending along a direction parallel to the extending direction of the sixth side portion, the first inner line and the third inner line intersect at a first inner intersection point, the second inner line and the fourth inner line intersect at a second inner intersection point, the first inner line and the fifth inner line intersect at a third inner intersection point, the second inner line and the sixth inner line intersect at a fourth inner intersection point, a first extension line obtained by extending the first inner line from the first inner intersection point toward the one side in the width direction intersects the third side portion at a first outer intersection point, a second extension line obtained by extending the second inner line from the second inner intersection point toward the one side in the width direction intersects the fourth side portion at a second outer intersection point, a third extension line obtained by extending the first inner line from the third inner intersection point toward the other side in the width direction intersects the fifth side portion at a third outer intersection point, a fourth extension line obtained by extending the second inner line from the fourth inner intersection point toward the other side in the width direction intersects the sixth side portion at a fourth outer intersection point, an inner line of the first side-end joining portion and an inner line of the second joining portion intersect at a first intersection point, an inner line of the second side-end joining portion and the inner line of the second joining portion intersect at a second intersection point, and when the gusset sheet portion and the front sheet portion are viewed from the front side in the pre-filling state, in a case where a first virtual line parallel to the height direction is drawn extending from the first intersection point toward the one side in the height direction, the first virtual line is located between a first inner virtual line connecting the first inner intersection point and the second inner intersection point and extending toward the other side in the height direction, and a first outer virtual line connecting the first outer intersection point and the second outer intersection point and extending toward the other side in the height direction, and in a case where a second virtual line parallel to the height direction is drawn extending from the second intersection point toward the one side in the height direction, the second virtual line is located between a second inner virtual line connecting the third inner intersection point and the fourth inner intersection point and extending toward the other side in the height direction, and a second outer virtual line connecting the third outer intersection point and the fourth outer intersection point and extending toward the other side in the height direction.

4. The pouch container according to claim 1, wherein when the gusset sheet portion is viewed from the front side in the pre-filling state, an outer edge of the gusset sheet portion includes:

a first side portion extending parallel to the width direction, a second side portion opposing the first side portion in the height direction on the other side in the height direction and extending parallel to the width direction, a third side portion connected to one end of the first side portion located on the one side in the width direction, the third side portion extending toward the other side in the height direction as extending outward in the width direction, a fourth side portion connected to one end of the second side portion located on the one side in the width direction, the fourth side portion extending toward the one side in the height direction as extending outward in the width direction, a fifth side portion connected to the other end of the first side portion located on the other side in the width direction, the fifth side portion extending toward the other side in the height direction as extending outward in the width direction, and a sixth side portion connected to the other end of the second side portion located on the other side in the width direction, the sixth side portion extending toward the one side in the height direction as extending outward in the width direction, the first joining portion includes:

a first inner line located on an inner side of the first side portion and extending along a direction parallel to the extending direction of the first side portion, a second inner line located on an inner side of the second side portion and extending along a direction parallel to the extending direction of the second side portion, a third inner line located on an inner side of the third side portion and extending along a direction parallel to the extending direction of the third side portion, a fourth inner line located on an inner side of the fourth side portion and extending along a direction parallel to the extending direction of the fourth side portion, a fifth inner line located on an inner side of the fifth side portion and extending along a direction parallel to the extending direction of the fifth side portion, and a sixth inner line located on an inner side of the sixth side portion and extending along a direction parallel to the extending direction of the sixth side portion, the first inner line and the third inner line intersect at a first inner intersection point, the second inner line and the fourth inner line intersect at a second inner intersection point, the first inner line and the fifth inner line intersect at a third inner intersection point, the second inner line and the sixth inner line intersect at a fourth inner intersection point, a first extension line obtained by extending the first inner line from the first inner intersection point toward the one side in the width direction intersects the third side portion at a first outer intersection point, a second extension line obtained by extending the second inner line from the second inner intersection point toward the one side in the width direction intersects the fourth side portion at a second outer intersection point, a third extension line obtained by extending the first inner line from the third inner intersection point toward the other side in the width direction intersects the fifth side portion at a third outer intersection point, a fourth extension line obtained by extending the second inner line from the fourth inner intersection point toward the other side in the width direction intersects the sixth side portion at a fourth outer intersection point, an inner line of the first side-end joining portion and an inner line of the second joining portion intersect at a first intersection point, an inner line of the second side-end joining portion and the inner line of the second joining portion intersect at a second intersection point, and when the gusset sheet portion and the front sheet portion are viewed from the front side in the pre-filling state, at least part of the one-side end portion of the second joining portion is located between a first inner virtual line connecting the first inner intersection point and the second inner intersection point and extending toward the other side in the height direction, and a first outer virtual line connecting the first outer intersection point and the second outer intersection point and extending toward the other side in the height direction, and at least part of the other-side end portion of the second joining portion is located between a second inner virtual line connecting the third inner intersection point and the fourth inner intersection point and extending toward the other side in the height direction, and a second outer virtual line connecting the third outer intersection point and the fourth outer intersection point and extending toward the other side in the height direction.

* * * * *